US011891758B2

(12) United States Patent
Huhtanen et al.

(10) Patent No.: US 11,891,758 B2
(45) Date of Patent: Feb. 6, 2024

(54) REFINER BLADE ELEMENT

(71) Applicant: Valmet Technologies Oy, Espoo (FI)

(72) Inventors: Juha-Pekka Huhtanen, Espoo (FI); Marko Loijas, Espoo (FI)

(73) Assignee: Valmet Technologies Oy, Espoo (FI)

( * ) Notice: Subject to any disclaimer, the term of this patent is extended or adjusted under 35 U.S.C. 154(b) by 638 days.

(21) Appl. No.: 17/004,882

(22) Filed: Aug. 27, 2020

(65) Prior Publication Data

US 2021/0062422 A1 Mar. 4, 2021

(30) Foreign Application Priority Data

Aug. 28, 2019 (EP) ..... 19193991

(51) Int. Cl.
*D21D 1/22* (2006.01)

(52) U.S. Cl.
CPC ..... *D21D 1/22* (2013.01)

(58) Field of Classification Search
CPC ..... D21D 1/22
USPC ..... 162/261
See application file for complete search history.

(56) References Cited

U.S. PATENT DOCUMENTS

2003/0213860 A1* 11/2003 Pilao ..... D21D 1/22 241/261.1

FOREIGN PATENT DOCUMENTS

EP 2304101 B1 9/2013
JP 2018048235 A 3/2018

* cited by examiner

*Primary Examiner* — Jacob T Minskey
(74) *Attorney, Agent, or Firm* — Stiennon & Stiennon

(57) ABSTRACT

A blade element pair (20) for a refiner (1, 2, 3) is intended for refining fibrous material. Each blade element (5, 5', 8, 8') of the blade element pair (20) has a refining surface (6, 9) with blade bars (16, 18) and blade grooves (17, 19) extending along the blade element (5, 5', 8, 8'), and openings (14,15) extending through the blade element (5, 5', 8, 8'). The openings (14, 15) in one of the blade elements (5, 5', 8, 8') is at different axial (A) or radial (R) positions from the openings (14,15) in the other blade element (5, 5', 8, 8') when the blade elements (5, 5', 8, 8') of the blade element pair (20) are set substantially opposite to each other.

14 Claims, 4 Drawing Sheets

REFINER BLADE ELEMENT

CROSS REFERENCES TO RELATED APPLICATIONS

This application claims priority on EP 19193991, filed Aug. 28, 2019, the disclosure of which is incorporated by reference herein.

STATEMENT AS TO RIGHTS TO INVENTIONS MADE UNDER FEDERALLY SPONSORED RESEARCH AND DEVELOPMENT

Not applicable.

BACKGROUND OF THE INVENTION

The invention relates to a refiner for refining fibrous material and especially to a blade element pair applicable to be used in the refiner intended for refining fibrous material.

EP-publication 2304101 B1 discloses a refiner and a method for refining fibrous material. The refiner disclosed in EP-2304101 B1 comprises at least one first refining surface and at least one second refining surface which are arranged at least partly substantially opposite to one another in such a manner that a refiner chamber receiving the material to be refined is formed between them. The first refining surface comprises openings arranged through the first refining surface, through which fibrous material to be refined is arranged to be fed into the refiner chamber, and/or the second refining surface comprises openings arranged through the second refining surface, through which fibrous material refined in the refiner chamber is arranged to be discharged from the refiner chamber, or vice versa.

By feeding the fibrous material to be refined through the first refining surface into the refiner chamber and/or by removing the already refined fibrous material from the refiner chamber through the second refining surface, or vice versa, it is possible to feed fibrous material into the refiner chamber so that the distribution of the material in the refiner chamber is substantially even, which effects the efficiency of the refining and the capacity of the refiner. The degree of grinding, i.e. the degree of refining, provided by the disclosed refiner is not, however, high enough for providing exceptionally far-refined, typically wood-based, fibrous material to be utilized for example as an additive in manufacturing of new biobased products.

SUMMARY OF THE INVENTION

An object of the present invention is to provide a novel blade element pair for a refiner intended for refining fibrous material.

In a blade element pair at least one of the blade elements is rotatable and the openings in one of the blade elements are at different axial or radial positions from the openings in the other blade element when the blade elements of the blade element pair are set substantially opposite to each other. A refining effect is produced by opposed refining surfaces one on each of the blade element pair.

Because in the solution disclosed the openings in the rotor refining surface do not coincide or overlap with the openings in the stator refining surface and therefore do not allow the material to be refined to go straight from the opening in the rotor refining surface to the opening in the stator refining surface, all the fibrous material is forced, at least to some extent, under influence of the refining effect because there is no fibrous material portion which could go through the refiner without ending up under the refining effect. This increases the degree of grinding of the fibrous material when compared to prior art solutions comprising openings extending through stator and rotor blade elements.

BRIEF DESCRIPTION OF THE DRAWINGS

In the following the invention will be described in greater detail by means of preferred embodiments with reference to the accompanying drawings, in which.

For the sake of clarity, the figures show some embodiments of the invention in a simplified manner. Like reference numerals identify like elements in the figures.

DESCRIPTION OF THE PREFERRED EMBODIMENTS

Figure 1:
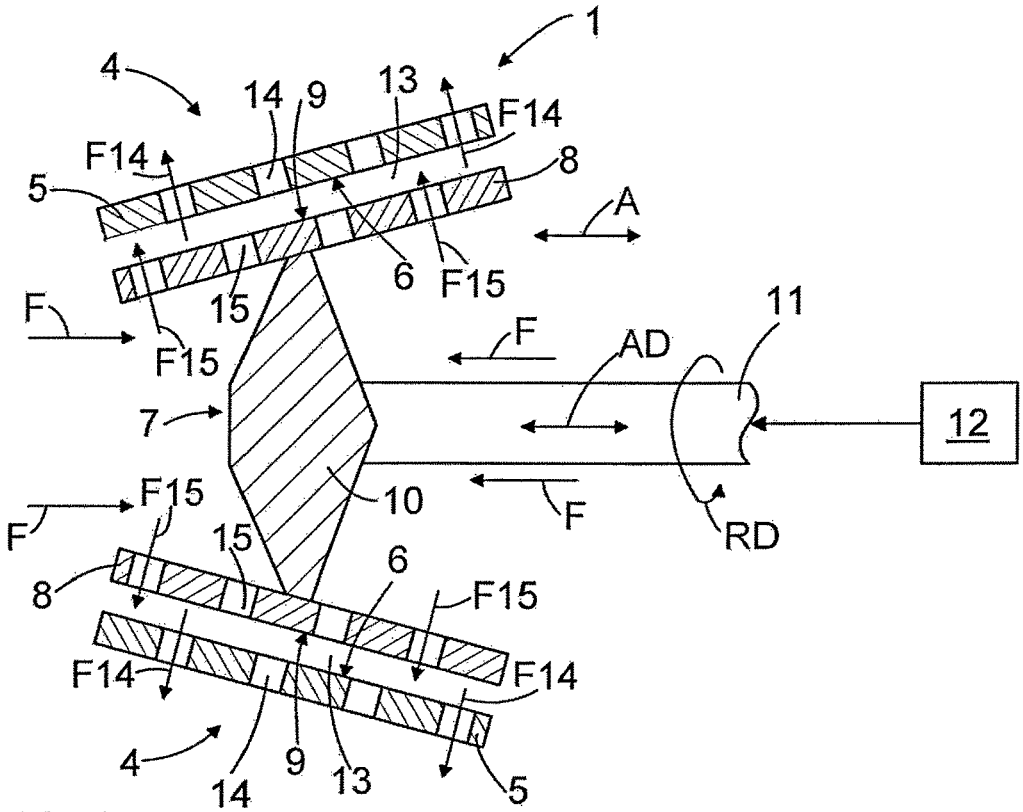
FIG. 1 shows schematically a side view of a conical refiner partly in cross-section.

FIG. 1 shows a very schematic side view of a conical refiner 1 partly in cross-section. The refiner 1 comprises a stationary refiner element 4, i.e., a stator 4, comprising of at least stator blade elements 5 having a refiner surface 6.

Figure 5:
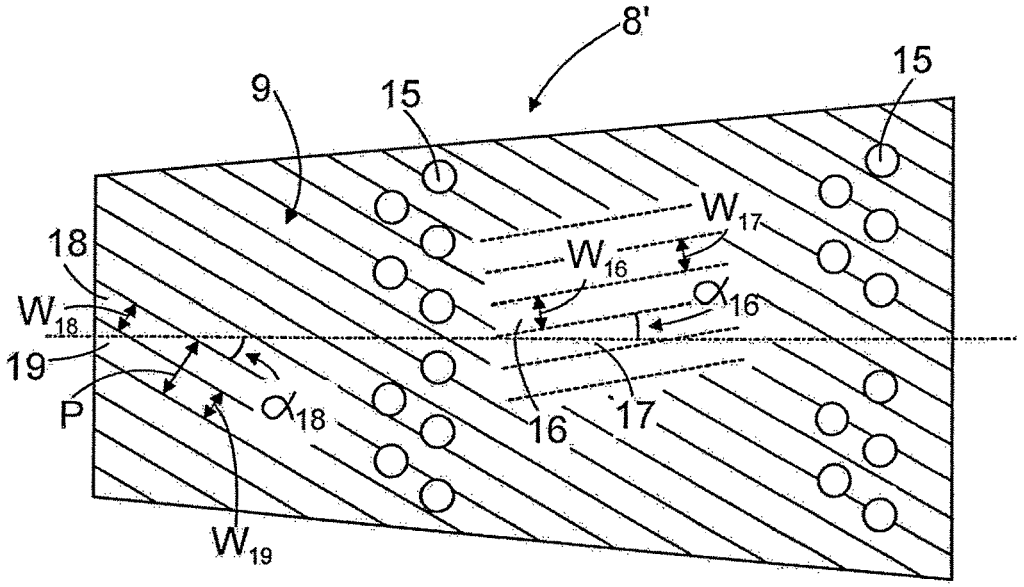
FIG. 5 shows schematically an upper view of a refining surface of a rotor blade element.
Figure 4:
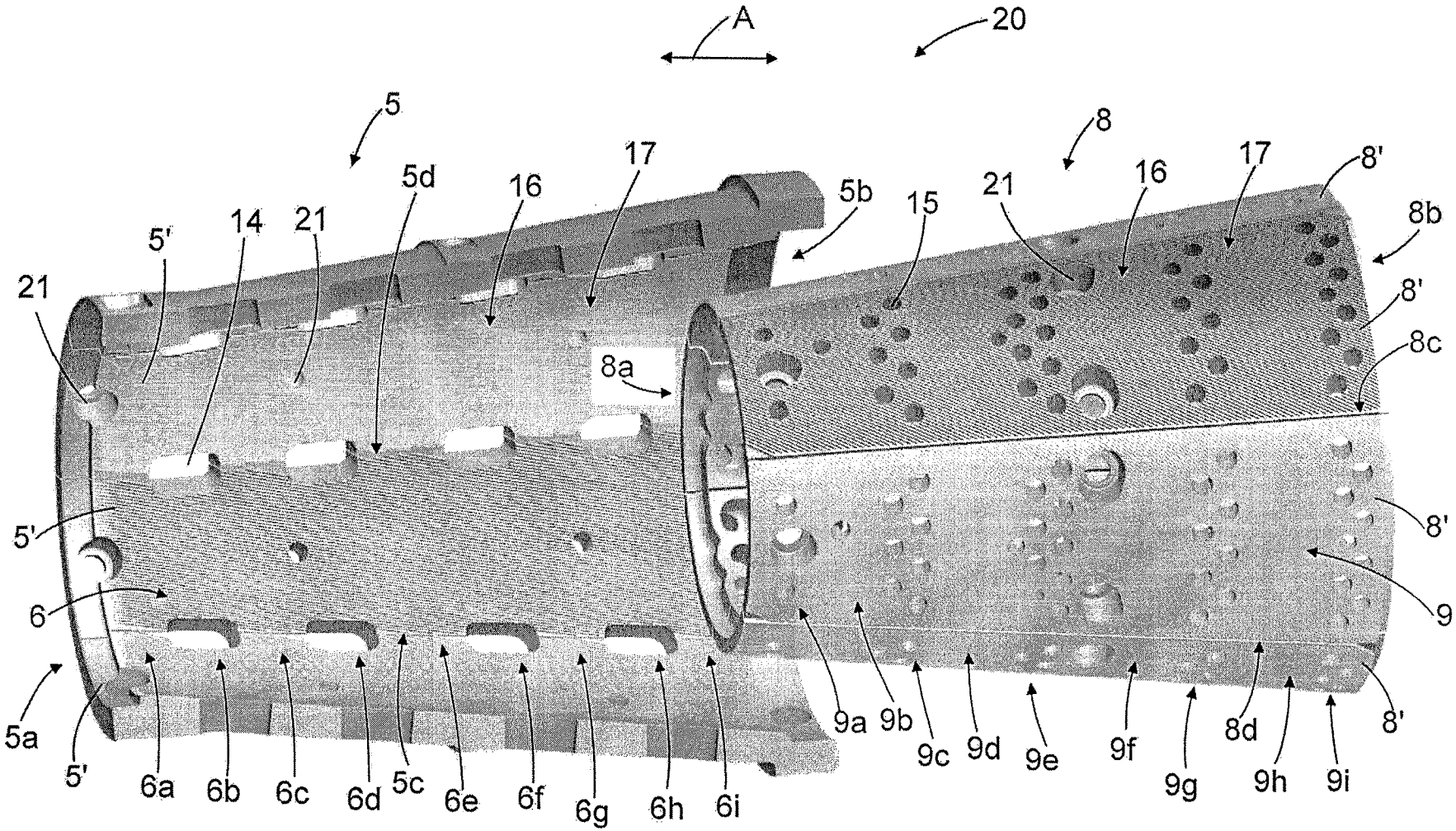
FIG. 4 shows schematically, partly in cross-section, a side view of a blade element pair for a conical refiner.

The stator 4 of FIG. 1 may be supported on a frame structure (not shown for clarity) of the refiner 1. According to an embodiment of the stator 4 it may comprise only one blade element 5 of a conical shape and extending over a whole periphery of the stator 4 so that this single blade element provides a complete and uniform refining surface 6 of the stator 4. According to another embodiment of the stator 4 it may comprise at least two segment-like blade elements, i.e. blade segments 5' as shown in FIG. 4, that are arranged adjacent to one another such that the refining surfaces 6 of the originally separate segment-like blade elements together provide the complete uniform refining surface 6 of the stator 4. The term blade element, when referring to the stator 4 of the refiner, may thus refer to a blade element providing the complete refining surface 6 of the stator 4 or to a blade segment providing only a part of the complete refining surface 6 of the stator 4. The refining surface 6 is typically provided with blade bars and blade grooves therebetween, an embodiment of the blade bars and the blade grooves are shown in FIGS. 4 and 5.

The refiner 1 as shown in FIG. 1 further comprises a rotary refining element 7, i.e. a rotor 7, comprising at least one rotor blade element 8 having a refining surface 9. According to an embodiment of the rotor 7 it may comprise only one blade element 8 of a conical shape and extending over a whole periphery of the rotor 7 so that this single blade element provides a complete uniform refining surface 9 of the rotor 7. According to another embodiment of the rotor 7 it may comprise at least two segment-like blade elements, i.e. blade segments 8' as shown in FIG. 4, that are arranged adjacent to one another whereby the refining surfaces 9 of originally separate segment-like blade elements together provide the complete uniform refining surface 9 of the rotor 7. The term blade element, when referring to the rotor 7 of the refiner, may thus refer to a blade element providing the complete refining surface 9 of the rotor 7 or to a blade segment providing only a part of the complete refining surface 9 of the rotor 7. The refining surface 9 is typically provided with blade bars and blade grooves therebetween, an embodiment of the blade bars and the blade grooves are shown in FIGS. 4 and 5.

Figure 2:
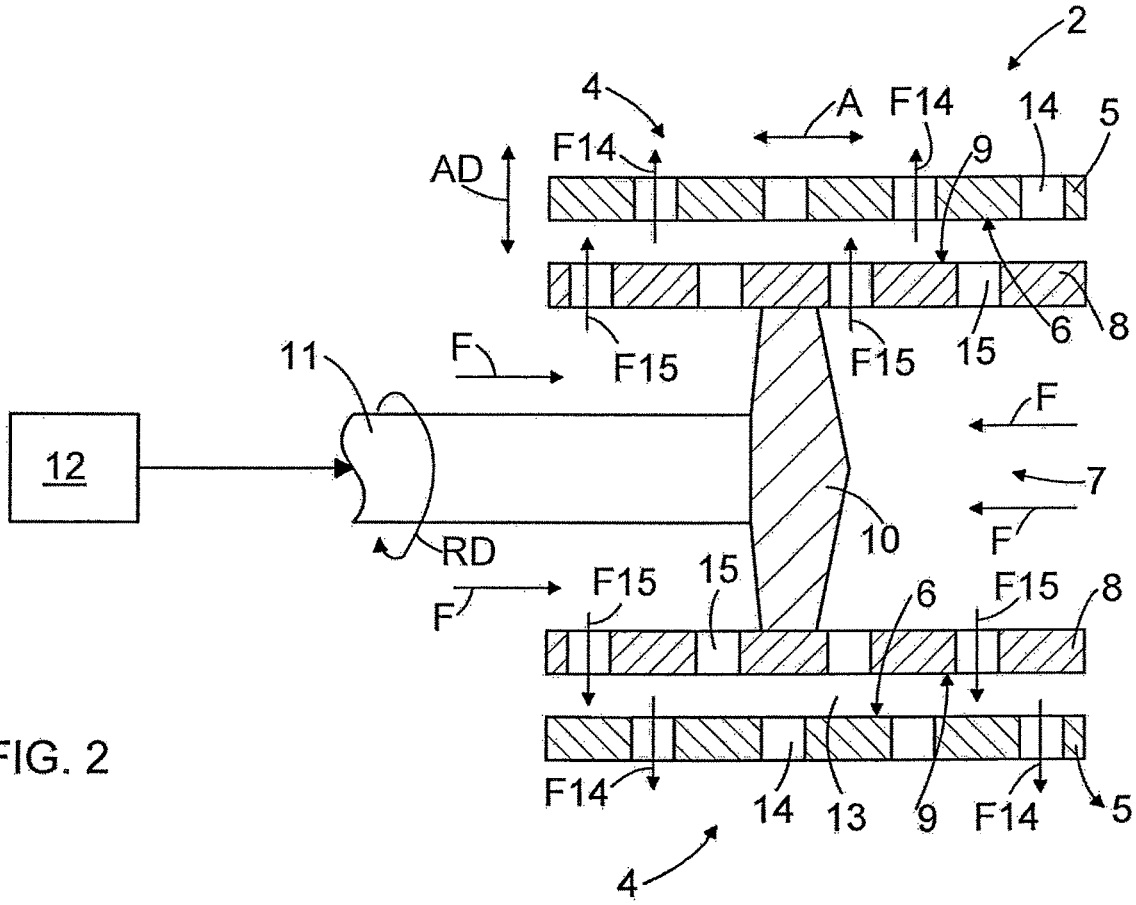
FIG. 2 shows schematically a side view of a cylindrical refiner partly in cross-section.
Figure 3:
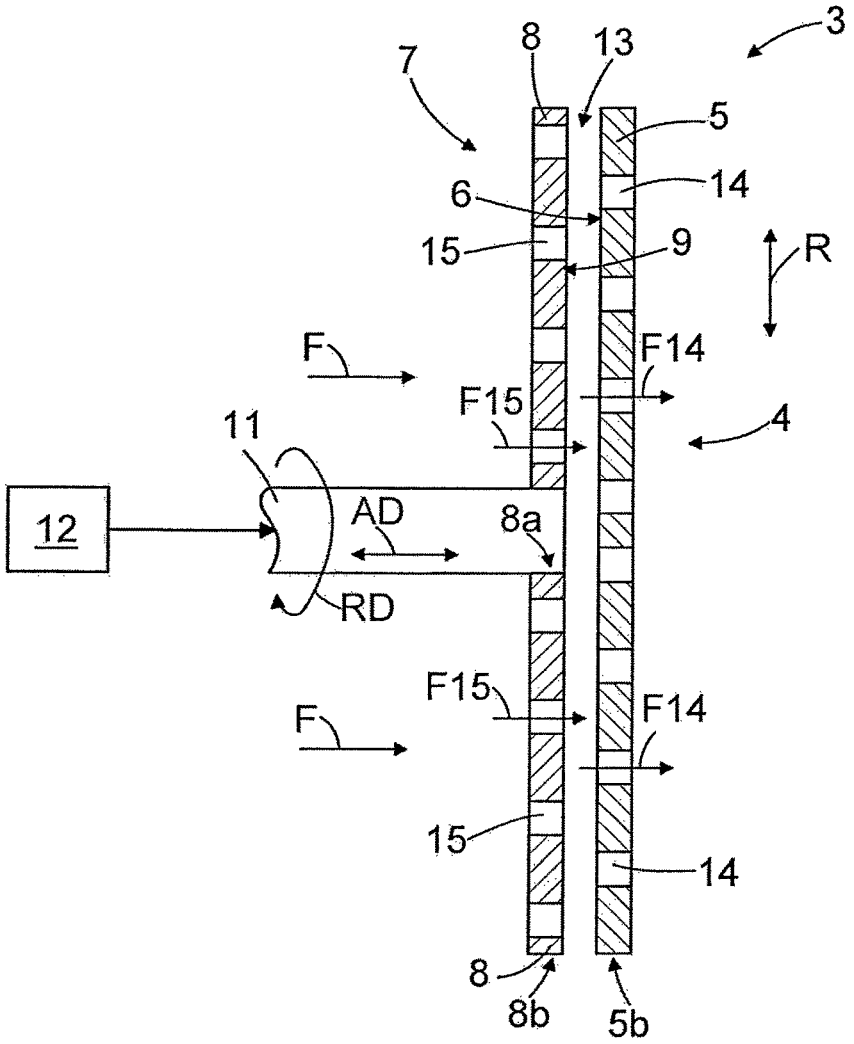
FIG. 3 shows schematically a side view of a disc refiner partly in cross-section.

The rotor 7 comprises a hub 10 which is shown in FIGS. 1-3 highly simplified and to which at least one rotor blade element 8 is mounted to and thus supported by the hub 10. The hub 10 of the rotor 7 is connected to a shaft 11 and the shaft 11 is connected to a highly schematically depicted motor 12 arranged to rotate the shaft 11 and the rotor 7. The shaft may for example rotate in a direction indicated by arrow RD. The refiner 1 may also comprise a loading device, (not shown for the sake of clarity), the loading device may be connected to the shaft 11 for moving the rotor 7 back and forth, as indicated schematically by arrow AD, in order to adjust a distance between the opposite blade elements 5, 8 in FIGS. 1 and 3. The loading device can adjust the distance between the opposite blade elements 5, 8 to controlling a blade gap therebetween. The blade gap defines a refiner chamber 13, the chamber increases or decreases size as the blade gap increases or decreases between the stator 4 and the rotor 7. The size of the refiner chamber 13 relative to the other components of the refiner is exaggerated in FIGS. 1-3.

The stator blade element 5 further comprises openings 14 extending through the blade element 5 and the rotor blade element 8 comprises openings 15 extending through the blade element 8, the openings 14, 15 thus extending through the whole thickness of the corresponding stator and rotor blade elements. An axial direction, indicated by arrow A, is defined parallel to the rotational axis of the shaft 11. In FIG. 1 the stator blade element 5 openings 14 and the rotor blade element 8 openings 15 are offset from each other in the axial direction A.

In other words, in the blade element pair comprising the stator blade element 5 and the rotor blade element 8 to be set substantially opposite to each other the openings 14, 15 in one of the blade elements 5, 8 are positioned not to coincide or overlap in the axial direction A with the openings 14, 15 in the other blade element 5, 8 when the blade elements 5, 8 are set substantially opposite to each other. The setting of the blade elements 5, 8 substantially opposite to each other thus refers to the positioning of the blade elements 5, 8 such that the refining surfaces of the blade elements 5, 8 are substantially directed toward each other, in other words, the refining surface of one blade element is set toward the refining surface of the other blade element of the blade element pair and end edges of the blades are aligned to match their operation position in the refiner.

The operation of the refiner 1 of FIG. 1 is as follows. The fibrous material to be refined is fed into an inner volume of the rotor 7 both through a first end of the refiner 1 having a larger diameter and through a second end of the refiner 1 having a smaller diameter, as schematically indicated by arrows indicated with reference sign F. Alternatively, the fibrous material to be refined may be fed into the inner volume of the rotor 7 only through the first end of the refiner 1 having the larger diameter or through the second end of the refiner 1 having the smaller diameter if there are openings extending through the hub 10 of the rotor 7, thus allowing the fibrous material flow from one end of the rotor 7 up to the other end of the rotor 7. It is to be noted that position of the cone can be contrary to that of FIG. 1 so that the smaller diameter end of the cone is located on the shaft side, the operation is still as described. The fibrous material is typically wood-based lignocellulose containing fiber material but could also be some other plant-based fibrous material. The consistency of the fibrous material to be fed into the refiner 1 is low, in the range of 0.5-5%, for example 0.5-3%, preferably 0.5-2%.

From the inner volume of the rotor 7 the fibrous material flows through the openings 15 in the rotor blade element 8 into the refining chamber 13, as shown schematically with arrows indicated with reference sign F15. In the refining chamber 13 the fibrous material is refined in response to the interaction of the stator refining surface 6 and the rotor refining surface 9. The fibrous material refined in the refining chamber 13 is discharged out of the refining chamber 13 through the openings 14 in the stator blade element 5, as shown schematically with arrows indicated with reference sign F14.

Because in the axial direction A of the stator blade element 5 and the rotor blade element 8 the openings 14 in the stator blade element 5 are at different positions relative to the positions of the openings 15 in the rotor blade element 8, i.e. because the openings 14 in the stator blade element 5 are aligned not to coincide or overlap with the openings 15 in the rotor blade element 8, there is no direct passage through the both elements 5, 8, thus all the fibrous material is forced, at least to some extent, under influence of the refining effect and there is no fibrous material portion which could go through the refiner 1 without ending up under the refining effect. This takes place because the openings 15 in the rotor refining surface 9 do not coincide with the openings 14 in the stator refining surface 6 and allow the material to be refined to go straight from the opening 15 in the rotor refining surface 9 to the opening 14 in the stator refining surface 9. This increases the degree of grinding of the fibrous material when compared to prior art solutions where a direct passage through stator and rotor blade elements is formed. Still, however, the capacity of the refining may be maintained.

FIG. 2 shows a very schematic side view of a cylindrical refiner 2 partly in cross-section. The basic structure and operation of the cylindrical refiner 2 is substantially similar to that of the conical refiner 1 of FIG. 1 above, the main difference being the cylindrical form or shape of the stator and rotor instead of the conical shape. Because of this difference between the form or shape of the stator and rotor the size of the refining chamber is adjusted in the cylindrical refiner 2 by adjusting the stator diameter, as indicated schematically with the arrow AD in FIG. 2. The positioning of the openings 14, 15 in the stator and rotor blade elements 5, 8 of the cylindrical refiner 2 is, however, similar to that shown and explained above in view of FIG. 1.

FIG. 3 shows a very schematic side view of a disc refiner 3 partly in cross-section. The basic structure and operation of the disc refiner 3 is substantially similar to that of the conical refiner 1 or the cylindrical refiner 2, the main difference being the disc-like form or shape of the stator 4 and the rotor 7 that are arranged at a substantially perpendicular angle relative to the shaft 11. For the sake of clarity, the hub 10 of the rotor 7 has been omitted in FIG. 3. Equally to the conical refiner 1 and the cylindrical refiner 2, the stator 4 and the rotor 7 may comprise only one blade element 5, 8 with a shape of a ring and extending over a whole periphery of the stator 4 or the rotor 7 so that this single blade element provides a complete uniform refining surface 6, 9 of the stator 4 or the rotor 7, or alternatively, the stator 4 and/or the rotor 7 may comprise at least two segment-like blade elements arranged adjacent to one another whereby the refining surfaces 6, 9 of the originally separate segment-like blade elements together provide the complete uniform refining surface 6, 9 of the stator 4 and/or the rotor 7. As explained above, the refining surface 6, 9 is typically provided with blade bars and blade grooves therebetween.

Furthermore, referring to the disc refiner of FIG. 3, the at least one stator blade element 5 comprises openings 14 extending through the blade element 5 and the at least one rotor blade element 8 comprises openings 15 extending through the blade element 8, the openings 14, 15 thus extending through the whole thickness of the stator and rotor blade elements 5, 8. In a radial direction of the one stator blade element 5 and in a radial direction of the rotor blade element 8, the radial direction indicated schematically by an arrow indicated with reference sign R in FIG. 3, the openings 14 in the stator blade element 5 are at different radial positions from the openings 15 in the rotor blade element 8 when the blade elements 5, 8 are opposite to each other. In other words, in the blade element pair comprising the stator blade element 5 and the rotor blade element 8 to be set substantially opposite to each other, the openings 14, 15 in one of the blade elements 5, 8 are positioned not to coincide or not to overlap in the radial direction R with the openings 14, 15 in the other blade element 5, 8 when the blade elements 5, 8 are set substantially opposite to each other.

The fibrous material to be refined is fed into the refiner 3 on the rotor 7 side of the inner volume of the refiner 3 as shown schematically with arrows indicated with the reference sign F. The fibrous material to be refined flows through the openings 15 in the rotor blade element 8 into the refining chamber 13, as shown schematically with arrows indicated with reference sign F15, and the fibrous material refined in the refining chamber 13 is discharged out of the refining chamber 13 through the openings 14 in the stator blade element 5, as shown schematically with arrows indicated with reference sign F14.

Because in the radial direction R of the stator blade element 5 and the rotor blade element 8 the openings 14 in the stator blade element 5 are at different positions relative to the positions of the openings 15 in the rotor blade element 8, i.e. because the openings 14 in the stator blade element are aligned not to coincide or overlap with the openings 15 in the rotor blade element 8, all the fibrous material is forced, at least to some extent, under influence of the refining effect, i.e. there is no fibrous material portion which could go through the refiner 1 without ending up under the refining effect, thus increasing the degree of grinding of the fibrous material when compared to prior art solutions.

Figure 6:
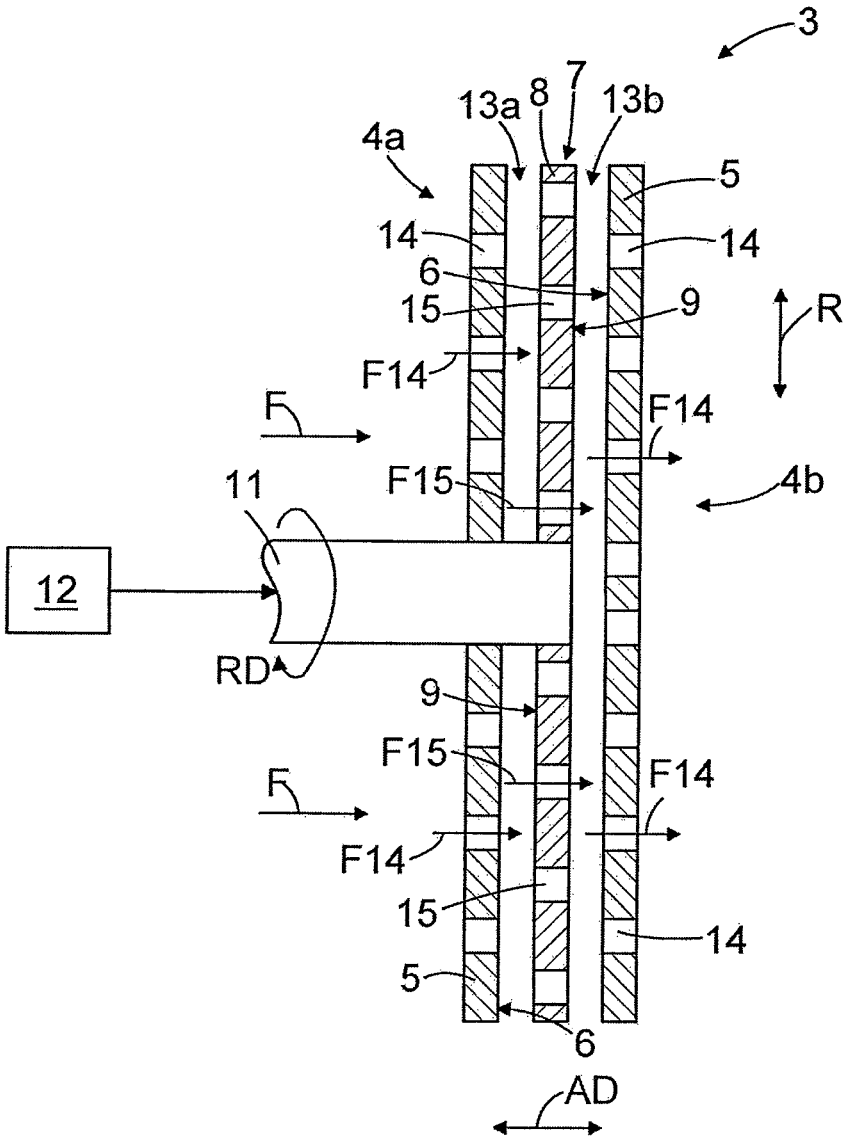
FIG. 6 shows schematically a side view of another disc refiner.

FIG. 6 shows schematically a side view of another disc refiner 3. The disc refiner 3 of FIG. 6 comprises a first stator 4*a* and a second stator 4*b* and therebetween a rotor 7, whereby there are provided two refining chambers, i.e. a first refining chamber 13*a* between the first stator 4*a* and the rotor 7 as well as a second refining chamber 13*b* between the second stator 4*b* and the rotor 7. The rotor 7 is arranged in a slidable manner at the end of the shaft 11 and the loading device (not shown for the sake of clarity) are allowed to load the second stator 4*b* so as to adjust the size of the refining chambers 13*a*, 13*b* as indicated schematically with the arrow AD.

The stators 4*a*, 4*b* each comprises at least one blade element 5. The refining surfaces 6 of the blade elements 5 at different stators 4*a*, 4*b* may have similar or different characteristics. The rotor 7 comprises at least one blade element 8 which is two-sided, i.e. blade element having refining surfaces 9 on both sides of the blade element 8. Alternatively the rotor 7 could comprise at least two one-sided refining elements connected to each other. The refining surfaces 9 at opposite sides of the rotor 7 may have similar or different characteristics.

When the refiner 3 of FIG. 6 is operated, the fibrous material to be refined is fed into the refiner 3 on the first stator 4*a* side of the inner volume of the refiner 3 as shown schematically with arrows indicated with the reference sign F. The fibrous material to be refined flows into the first refining chamber 13*a* through the openings 14 in the stator blade element 5 of the first stator 4*a*, as shown schematically with arrows F14 on the left side of the rotor 7. The fibrous material refined in the first refining chamber 13*a* is discharged out of the first refining chamber 13*a* into the second refining chamber 13*b* through the openings 15 in the rotor blade element 8 of the rotor 7, as shown schematically with arrows F15. Furthermore, the fibrous material refilled in the second refining chamber 13*b* is discharged out of the second refining chamber 13*b* through the openings 14 in the stator blade element 5 of the second stator 4*b*, as shown schematically with arrows F14 on the right side of the rotor 7.

The disc refiner 3 of FIG. 6 is an example of a refiner comprising two blade element pairs, i.e. a first blade element pair comprising the stator blade element 5 of the first stator 4*a* and the rotor blade element 8 of the rotor 7 as well as a second blade element pair comprising the stator blade element 5 of the second stator 4*b* and the rotor blade element 8 of the rotor 7, the rotor blade element 8 of the rotor 7 thus being common to the both blade element pairs. Other solutions for providing a refiner with more than one blade element pair is also possible, for example by increasing a number of the rotors in the refiner.

FIG. 4 shows schematically, partly in cross-section, a side view of a blade element pair 20 for a conical refiner 1. The blade element pair 20 comprises a stator blade element 5 comprising a number of adjacently positioned stator blade segments 5'. Each stator blade segment 5', and thereby the complete stator blade element 5, comprises a first edge 5*a*, i.e. a first end edge 5*a* or an inner edge 5*a* intended to be directed toward the refiner end having the smaller diameter. Similarly, the stator blade element 5, and thus each stator blade segment 5', comprises a second edge 5*b*, i.e. a second end edge 5*b* or an outer edge 5*b* intended to be directed toward the refiner end having the larger diameter. The axial direction A of the stator blade element 5, and thereby the axial direction A of each stator blade segment 5', extends between the first edge 5*a* and the second edge 5*b*. Each individual stator blade segment 5' further comprises side edges 5*c*, 5*d* extending between the first 5*a* and the second 5*b* edges. Inner surfaces of the stator blade segments 5' are provided with stator blade bars 16 and stator blade grooves 17 therebetween forming the refining surface 6 of each individual stator blade segment 5' and thereby the refining surface 6 of the complete stator blade element 5.

The blade element pair of FIG. 4 further comprises a rotor blade element 8 comprising a number of adjacently positioned rotor blade segments 8'. Each rotor blade segment 8', and thus the complete rotor blade element 8, comprises a first edge 8*a*, i.e. a first end edge 8*a* or an inner edge 8*a* intended to be directed toward the refiner end having the smaller diameter. Similarly, the rotor blade element 8, and thus each rotor blade segment 8', comprises a second edge 8*b*, i.e. a second end edge 8*b* or an outer edge 8*b* intended to be directed toward the refiner end having the larger diameter. The axial direction A of the rotor blade element 8, and thereby the axial direction A of each rotor blade segment 8', extends between the first edge 8*a* and the second edge 8*b*. Each individual rotor blade segment 8' further comprises side edges 8*c*, 8*d* extending between the first 8*a* and the second 8*b* edges. As shown in FIG. 5 the outer surfaces of the rotor blade segments 8' are provided with rotor blade bars 18 and rotor blade grooves 19 therebetween forming the refining surface 9 of each individual rotor blade segment 8' and thereby the refining surface 9 of the complete rotor blade element 8. Fastening holes in the blade segments 5', 8', intended to receive fastening means, e.g., bolts or screws, for fastening the blade segments 5', 8' in the refiner, are denoted with reference number 21 in FIG. 4.

Each stator blade segment 5', and thereby the complete stator blade element 5 comprises in the axial direction A thereof successive refining surface zones 6*a*, 6*b*, 6*c*, 6*d*, 6*e*, 6*f*, 6*g*, 6*h*, 6*i*, wherein the refining surface zones 6*b*, 6*d*, 6*f*, 6*h* are refining surface zones comprising the openings 14 extending through the whole thickness of the stator blade segment 5' and the refining surface zones 6*a*, 6*c*, 6*e*, 6*g* and 6*i* are refining surface zones of solid structure, i.e. not comprising such openings. Mutually, each rotor blade segment 8', and thereby the complete rotor blade element 8 comprises in the axial direction A thereof successive refining surface zones 9*a*, 9*b*, 9*c*, 9*d*, 9*e*, 9*f*, 9*g*, 9*h*, 9*i*, wherein the refining surface zones 9*a*, 9*c*, 9*e*, 9*g* and 9*i* are refining surface zones provided with the openings 15 extending through the whole thickness of the rotor blade segment 8' and the refining surface zones 9*b*, 9*d*, 9*f*, 9*h* are refining surface zones of solid structure, i.e. not comprising such openings. Thus, there is at least one zone which is solid and at least one zone which has openings in both the rotor element and the stator element. More preferably, at least one of the elements has more than one solid zone in addition to a zone with openings whereas in the other element the amount and order of solid zones and zones with openings is reversed.

When the conical refiner 1 is assembled and the stator blade element 5 and the rotor blade element 8 are set substantially opposite to each other for the use, the refining surface zones 9*a*, 9*c*, 9*e*, 9*g* and 9*i* of the rotor blade segments 8 comprising the openings 15 are set in the axial direction A of the blade segments, i.e. in the axial direction of the refiner, toward the refining surface zones 6*a*, 6*c*, 6*e*, 6*g* and 6*i* of solid structure in the stator blade segment 5, and correspondingly, the refining surface zones 6*b*, 6*d*, 6*f*, 6*h* of the stator blade segments 5' comprising the openings 14 are set in the axial direction A of the blade segments 5', 8' toward the refining surface zones 9*b*, 9*d*, 9*f*, 9*h* of solid structure in the rotor blade segments 8'. In other words, the zones with the openings 14, 15 as well as the solid zones of the opposite elements go in shifted phases, i.e. in reversed order. Thereby the refining surface zones provided with openings in one blade segment 5', 8' are set opposite to the refining surface zones without openings in the other blade segment 5', 8'. This means that in the blade element pair 20 the refining surface zones of the blade segments 5', 8' comprising openings 14, 15 are aligned not to coincide or overlap with each other in the axial direction A of the blade segments 5', 8' when the refining surfaces 6, 9 of the blade segments 5', 8' are substantially opposite to each other. In other words, the openings 14, 15 of the opposite elements 5, 8 do not overlap and thus no rectilinear passage through both elements is formed. This, in turn, means that no fibrous material portion can go from the opening 15 in the rotor blade element 8 straight to the opening 14 in the stator blade element 5 without getting under influence of the refining because there will be no straight see through connection between the openings 14 in the stator blade element 5 and the openings 15 in the rotor blade element 8.

The refining surface zones disclosed above may be utilized in the blade elements for the cylindrical 2 (separated in the axial direction A) and disc refiners 3 (separated in the radial direction R). More generally the rule is: opposed refiner elements having: refining surface comprising bars and grooves therebetween, and through holes which pass through the refining elements, are arranged so the through holes in opposed refiner elements do not overlap, as at least one of the opposed refining elements is rotated relative to the other. This arrangement of the through holes increases the level of refining that takes place between blade elements because any fibrous material which passes through a hole into a refining chamber formed between two opposed blade elements must undergo refining on the refining surfaces of the blade elements as it travels between the through hole through which it enters the refining chamber until such time as it travels to a through hole in the opposed refining element through which it can exit.

In the blade element pair of FIG. 4 the openings 15 in the rotor blade segments 8' are arranged at a central portion of the rotor blade segments 8' whereas the openings 14 in the stator blade segments 5' are arranged at the side edges 8*c*, 8*d* of the stator blade segments 5'. The openings 14 in the stator blade segments 5' are thus indents arranged at the side edge 8*c*, 8*d* of the blade segments 5', the indents extending through the whole thickness of the blade segment 5' and from the side edge 8*c*, 8*d* of the blade segment 5' toward the opposite side edge 8*c*, 8*d*. The advantage of the openings being indents at the side edge of the blade segment is that a rigidity of the blade segment is higher than the rigidity of the blade segment having openings at the central portion of the blade segment. This, in turn, provides a possibility to reduce the thickness of the blade segment, thus reducing weight of the blade segment and energy needed to rotate the rotor if applied at the rotor blade segments too.

In the blade element pair of FIG. 4 the openings 15 in the rotor blade segments 8' are round whereas the openings 14 in the stator blade segments 5' are elongated. Alternatively, the openings 14, 15 could also be for example oval or triangle or have different polygonal shapes. The size of the openings may vary largely from a minimum of a fiber length to a maximum of even half of the element length and the size of the openings may vary between different refining surface zones. A total open area of the openings 14, 15 in the blade element 5, 5', 8, 8' is from 5% to 30% of the surface area of the refining surface, 6, 9 of the blade element 5, 5', 8, 8', typically about 16-24%, but values less than 10% are sometimes preferred, depending on refiner capacity and raw material used. A low total open area of the openings 14, 15 relative to the surface area of the refining surface, 6, 9 of the blade element 5, 5', 8, 8' increases a total length of cutting edges of the blade bars, thus increasing the degree of grinding of the refined fibrous material. As explained, the open area consists of one or more openings 14, 15 the shape of which can be round, oval, triangle or any polygonal shape and may be similar or may vary within a refining element and/or within a refining element pair, for example the shape of the openings may differ zonewise, like dissimilar openings on the first end area to the second end area of the element, or the shape or shapes of the openings 14, 15 may be different in the stator element compared to those of the rotor element as in FIG. 4. Further, the size of the openings 14, 15 may vary within a refining element and/or within a refining element pair, for example the size of the openings may vary zonewise, like smaller openings on the first end area and larger openings on the second end area of the element or vice versa, or the openings 15 of the rotor element may be of different size from the openings 14 of the stator element as in FIG. 4. The openings 14, 15 within an element may be like holes or perforations lying in the middle part between the side edges of the element but they may also be like indents or cutouts at the side edges.

FIG. 5 shows schematically an upper view of a rotor blade segment 8' of FIG. 4 and a refining surface 9 thereof. The refining surface 9 comprises blade bars 18 and blade grooves 19. The blade bars 18 provide the refining effect to the fibrous material and the blade grooves 19 convey the material to be refined on the refining surface 9. In FIG. 5 it is shown also, as superimposed by broken lines, some blade bars 16 and blade grooves 17 of a stator blade segment 5' to be set opposite to the rotor blade segment 8'. In the following properties of the refining surface 9 for the rotor blade element or segment are considered but properties of the refining surface 6 for the stator blade element or segment are similar unless otherwise specifically mentioned.

According to an embodiment a pitch P of the refining surface 9, i.e., a common width of a single blade bar 18 and of a single blade groove 19 next to the blade bar 18 is at most 3 mm. The pitch P of at most 3 mm provides a very dense blade bar—blade groove—configuration, whereby a cutting edge length provided by the blade bars 16, 18 of the stator and rotor blade elements 5, 8 in the refiner is very high. This, together with the opening configuration in the stator and rotor blade elements 5, 8 as disclosed above, has the effect that the degree of grinding of the fibrous material to be refined will be very high, even so high that at least part of the refined material will have particle size properties of nanofibrillar cellulose. The term "nanofibrillar cellulose" refers herein to a collection of separate cellulose microfibrils or microfibril bundles derived from plant-based, and especially wood-based fibrous material. Synonyms for the nanofibrillar cellulose (NFC) are for example nanofibrillated cellulose, nanocellulose, microfibrillar cellulose, cellulose nanofiber, nano-scale cellulose, microfibrillated cellulose (MFC) or cellulose microfibcrils. Depending on the degree of grinding a particle size of the separate cellulose microfibrils or microfibril bundles is of some nanometers (nm) or micrometers (μm). A mean length of the separate cellulose microfibrils or microfibril bundles may, for example, be 0.2-200 μm and a mean diameter may, for example, be 2-1000 nm.

According to an embodiment a width $W_{16}$, $W_{18}$ of the respective blade bar 16, 18 is at most half of the pitch P of the blade element. According to this embodiment, and referring back to FIG. 5 it thus means that the width $W_{16}$, $W_{18}$ of the respective blade bar 16, 18 is at most equal to a width $W_{17}$, $W_{19}$ of the blade groove 17, 19. The effect of this embodiment is that volume of the blade grooves 17, 19 in the blade elements 5, 5', 8, 8' will be high enough to prevent a clogging of the refining surfaces 6, 9 of the blade elements 5, 5', 8, 8'.

According to an embodiment a height of the blade bar 16, 18 is typically at most 10 mm but heights lower than 10 mm, for example less than 5 mm, even less than 3 mm may be preferred in case of very dense groove-bar-pattern. Typically bar height is reduced during operation, but in the refiner of the solution even low heights are possible without sacrificing hydraulic capacity because pulp is fed through the holes and groove volume is not limiting the hydraulic capacity.

The pitch of the blade elements and the total open area of the openings in the blade elements may be selected in combination such that the common cutting edge length of the blade bars in the refiner is preferably at least 50 kin per one revolution of the rotor 7.

According to an embodiment of the blade element pair 20 the blade bars 16, 18 in the blade elements 5, 5', 8, 8' forming the blade element pair 20 are crosswise to each other. Referring again to FIG. 5 showing the refining surface 9 of the rotor blade segment 8' and the blade bars 18 and the blade grooves 19 therein it can be seen that the blade bars 18 and the blade grooves 19 are arranged at a blade bar angle α18 of about 30° relative to the axial direction A, depicted by the dot-and-dash line in FIG. 5. Generally, the blade bar angle α18 in the rotor blade element is 0°-75°, for example 10°-50°. The blade bars 16, and thereby the blade grooves 17, in the stator blade segment 5' are, in turn, arranged at a blade bar angle $\alpha_{16}$ of about 0°-75° relative to the axial direction A to the opposite direction relative to the blade bars 18 and the blade grooves 19 in the rotor blade segment 8'. The orientation of the blade bars 16 and blade grooves 17 in the stator blade segment 5' relative to the orientation of the blade bars 18 and the blade grooves 19 in the rotor blade segment 8' are indicated schematically in FIG. 5 by broken lines. Generally, the blade bar angle $\alpha_{16}$ in the stator blade element may, for example, be 5° to 40°.

The crosswise orientation of the blade bars 16, 18 in the opposite blade elements 5, 5', 8, 8' in the blade element pair ensures that sufficiently high shear forces are to be focused to the fibrous material to be refined by the opposite blade bars 16, 18. For that effect to be achieved an angle between the blade bars 16, 18 in the refining surfaces 6, 9 of the oppositely set blade elements 5, 5', 8, 8', i.e. the intersecting angle $\alpha_{16}+\alpha_{18}$ may vary between 10°-100°.

It should be understood that the term "substantially" as used in the specification and claims means: for the most part or essentially, indicating that the claims are not avoided by an insubstantial difference.

It will be obvious to a person skilled in the art that, as the technology advances, the inventive concept can be implemented in various ways. The invention and its embodiments are not limited to the examples described above but may vary within the scope of the claims. Consequently, even if in the embodiments above it is presented that the fibrous material is to be fed into the refiner on the rotor side, the fibrous material could alternatively be fed into the refiner on the stator side. In that case, however, the feed pressure may have to be increased because the stator, as a stationary element, does not enhance the fed of the material to be refined into the refining chamber of the refiner.

We claim:

1. A blade element pair for a refiner for refining fibrous material comprising:

at least one first blade element for mounting to the refiner to rotate about an axis defining an axial direction and a radial direction, the at least one first blade element having a first refining surface extending in at least one of the radial direction and the axial direction, the first refining surface having first blade bars and first blade grooves therebetween, the first blade bars and first grooves extending along the first blade element in at least one of the radial direction and the axial direction and wherein the at least one first blade element has first openings for the passage therethrough of material to be refined and which extend through the at least one first blade element in at least one of the radial direction and the axial direction, wherein the first openings have a first length in the axial direction;

at least one second blade element for mounting to the refiner, the at least one second blade element having a second refining surface extending in at least one of the radial direction and the axial direction, the second refining surface having second blade bars and second blade grooves therebetween and extending along the second blade element in at least one of the radial direction and the axial direction and wherein the at least one second blade element has second openings for the passage therethrough of material to be refined which extend through the second blade element in at least one of the radial direction and the axial direction, wherein the second openings have a second length in the axial direction which is greater than the first length;

wherein the at least one first blade element and the at least one second blade element when mounted to the refiner are set substantially opposed to each other in such a manner that the first and second refining surfaces are opposed such that a refiner chamber for receiving material to be refined is formed therebetween; and wherein the first openings in the first blade element and the second openings in the second blade openings are arranged at different axial or radial positions such that material to be refined does not pass between the first openings and the second openings without engaging the first refining surface and the second refining surface.

2. The blade element pair of claim 1 wherein the first refining surface and the second refining surface each have at least one refining surface zone without openings and at least one refining surface zone with openings.

3. The blade element pair of claim 1 wherein the at least one first blade element has a first edge and a second edge between which the first refining surface extends, and wherein the at least one second blade element has a first edge and a second edge between which the second refining surface extends; and wherein the first refining surface and the second refining surface each comprises a plurality of refining surface zones having openings extending through the blade element.

4. The blade element pair of claim 1 wherein at least one of the first blade element and the second blade element is comprised of a plurality of blade segments, each blade segment having a first and a second end edge and a first and a second side edge extending between the first and second end edges;

wherein at least one of the first and second openings cut out indents in at least one of the first and second side edges, the indents extending through a whole thickness of the blade segment and extending from the first side edge of the blade segment toward the opposite second side edge or vice versa.

5. The blade element pair of claim 1 wherein the first blade bars and first blade grooves define a first pitch comprising one of said first blade bars and one of said first blade grooves, wherein the first pitch is repeated to form the first refining surface and each first pitch is at most 3 mm wide in a direction transverse to the said one of said first blade bars and one of said first blade grooves; and wherein the second blade bars and second blade grooves define a second pitch comprised of one of said second blade bars and one of said second blade grooves, wherein the second pitch is repeated to form the second refining surface and each second pitch is at most 3 mm wide in a direction transverse to the said one of said second blade bars and said one of said second grooves.

6. The blade element pair of claim 5 wherein the width of the first blade bars is at most half of the first pitch and wherein the width of the second blade bars is at most half of the second pitch.

7. The blade element pair of claim 6 wherein the first blade bars and the second blade have a height of at most 10 mm.

8. The blade element pair of claim 1 wherein the first blade bars of the first refining surface and the second blade bars of the second refining surface are crosswise to each other.

9. The blade element pair of claim 8 wherein an intersecting angle between the first blade bars and the second blade bars is from 10° to 100°.

10. The blade element pair of claim 1 wherein the first openings define a first total open area of the first blade element, and wherein the second openings define a second total open area of the second blade element and wherein the first open area is from 5% to 30% of a surface area of the first refining surface of the first blade element and the second open area is from 5% to 30% of a surface area of the second refining surface of the second blade element.

11. The blade element pair of claim 1 wherein the second length is greater than twice the first length.

12. The blade element pair of claim 1 wherein the first blade openings are circular and the second blade openings are elongated.

13. The blade element pair of claim 1 wherein there are more first blade openings than second blade openings.

14. A blade element pair for a refiner for refining fibrous material comprising:

at least one first blade element for mounting to the refiner to rotate about an axis defining an axial direction and a radial direction, the at least one first blade element having a first refining surface extending in at least one of the radial direction and the axial direction, the first refining surface having first blade bars and first blade grooves therebetween, the first blade bars and first grooves extending along the first blade element in at least one of the radial direction and the axial direction and wherein the at least one first blade element has first openings for the passage therethrough of material to be refined which extend through the at least one first blade element in at least one of the radial direction and the axial direction, wherein the first openings have a first length in the radial direction;

at least one second blade element for mounting to the refiner, the at least one second blade element having a second refining surface extending in at least one of the radial direction and the axial direction, the second refining surface having second blade bars and second blade grooves therebetween and extending along the second blade element in at least one of the radial direction and the axial direction and wherein the at least one second blade element has second openings for the passage therethrough of material to be refined which extend through the second blade element in at least one of the radial direction and the axial direction, wherein the second openings have a second length in the radial direction which is greater than the first length;

wherein the at least one first blade element and the at least one second blade element when mounted to the refiner are set substantially opposed to each other in such a manner that the first and second refining surfaces are opposed such that a refiner chamber for receiving material to be refined is formed therebetween; and wherein the first openings in the first blade element and the second openings in the second blade openings are arranged at different axial or radial positions such that material to be refined does not pass between the first openings and the second openings without engaging the first refining surface and the second refining surface.

* * * * *